US006022169A

United States Patent [19]

Kim et al.

[11] Patent Number: 6,022,169

[45] Date of Patent: Feb. 8, 2000

[54] EXPANSION JOINT APPARATUS

[75] Inventors: Kwang-Young Kim, Kyeongsangnam-Do; Dae-Won Park, Pusan, both of Rep. of Korea

[73] Assignee: Korea Institute of Machinery and Materials, Rep. of Korea

[21] Appl. No.: 09/098,262

[22] Filed: Jun. 16, 1998

[30] Foreign Application Priority Data

May 9, 1998 [KR] Rep. of Korea ..... 98-16666

[51] Int. Cl.[7] ..... E01C 11/02; E01C 11/14; E01C 5/14; E01D 19/06; E01D 19/04

[52] U.S. Cl. ..... 404/52; 404/47; 404/68; 14/73.1; 14/73.5

[58] Field of Search ..... 14/73.1, 73.5; 404/47, 52, 68, 69, 74, 50, 56

[56] References Cited

U.S. PATENT DOCUMENTS 3,375,763 4/1968 Welch ..... 14/73.1
3,797,952 3/1974 Pommerening et al. ..... 14/73.1
4,120,066 10/1978 Leroux ..... 14/73.1
4,925,339 5/1990 Smith ..... 404/4
5,028,168 7/1991 Conversy ..... 404/47
5,181,793 1/1993 Dekel ..... 404/4
5,211,505 5/1993 Ueda ..... 404/47

*Primary Examiner*—Thomas B. Will
*Assistant Examiner*—Gary S. Hartmann
*Attorney, Agent, or Firm*—Fish & Richardson P.C.

[57] ABSTRACT

Expansion joint apparatus which can be installed at junctions between upper structures of a road and a bridge. In a state of applying the apparatus to a bridge, each wheel in a same shaft of a vehicle passes the apparatus at different time spots, that is, when any one wheel passes one of the support members, the other wheel passes the other support member. Thus, a load applied to the bridge is distributed. The apparatus is made of material having high stiffness so that it lasts a long time. By changing the number of the intermediate support members, an expansion range of the apparatus can be controlled.

6 Claims, 8 Drawing Sheets

EXPANSION JOINT APPARATUS

BACKGROUND OF THE INVENTION

1. Field of the Invention

The present invention relates to an expansion joint apparatus for telescopically joining upper structures of roads and bridges.

2. Description of the Prior Art

Structures which make up a bridge expand and compress with temperature and load changes. So, an upper structure of the bridge which is built a length over a predetermined length is divided into a plurality of pieces which are spaced apart from each other by a proper clearance (generally called as "idle space"). In the idle space, a joint apparatus is installed so as to allow wheels of vehicles to smoothly pass thereon.

U.S. Pat. No. 5,211,505 (issued to Akira Ueda) discloses an expansion joint that is capable of maintaining the flatness of the road surface and also fully allowing for the expansive and contractive behavior of the slabs. Akira Ueda's expansion joint is explained by an attached drawing of FIG. 1. FIG. 1 is a sectional view showing a state where a conventional expansion joint has been applied.

Notched portions 2,2 are respectively prepared by partly cutting off end portions of pavement layers 3,3 over slabs 1,1 arranged opposite to each other while leaving some idle space 10 therebetween. A water proof member 8 is preferably charged in the idle space 10. A cover member 4 is laid over the opposite ends of the opposing slabs 1,1 to cover them. A composite layer 5, comprising rubber grains (not shown) and a binder (not shown), is placed in the notched portions 2,2 such that the upper surface may be made even with that of the pavements 3,3.

However, in the above-mentioned expansion joint, the cover member and the water proof member are buried in the composite layer thereby making it difficult for the cover member and the water proof member to be repaired.

SUMMARY OF THE INVENTION

The present invention is intended to overcome the above described disadvantages. Therefore, it is an object of the present invention to provide an expansion joint apparatus which can attenuate a vibration and a noise while vehicles are passing thereon.

Also, it is an another object of the present invention to provide an expansion joint apparatus which can be easily installed at a bridge, be properly maintained, and be adjusted with the bridge according to the interval changes of upper structures of the bridge.

In order to achieve the object of the present invention, there is provided an expansion joint apparatus for connecting slabs which are spaced apart from each other by a predetermined interval, which comprises:

a couple of first support members for preventing vehicle wheels from being sunk between slabs and attenuating an impact due to a height difference of the slabs, the first support members being installed at opposing surfaces of the slab, respectively;

a couple of brackets for transmitting movements of the slabs to the first support members, each bracket being installed between each first support member and the adjacent slab;

at least one second support member for preventing the vehicle wheels from being sunk between the first support members and attenuating an impact occurred by a height difference of the first support members, the second support member being installed between the first support members and moving together with the first support members;

a post extending downward from the second support member;

first link members for preventing the first and second support members from drooping under weight of the first and second support members and an external load, each first link member being connected at a first end thereof to each bracket and being connected at a second end thereof to the post, the second end being opposite to the first end; and second link members for preventing the first and second support members from drooping under the weight of the first and second support members and the external load and urging the second support member to move together with the first support members, each second link member being connected at a third end thereof to the post and being connected at a fourth end thereof to each first link member adjacently positioned, the fourth end being opposite to the third end.

According to a preferred embodiment of the present invention, each of the first support members includes a first upper rail for frictionally making contact with the vehicle wheels and a first lower rail extending downward from the first upper rail so as to be assembled to each bracket, the first upper rail of any one of the first support members having a corrugated surface thereof facing the other first support member, the corrugated surfaces of first support members connecting to each other, the second support member including a second upper rail for frictionally making contact with the vehicle wheels and a second lower rail extending downward from the second upper rail so as to be connected to the post, the second upper rail being formed at both sides thereof facing the first upper rails with corrugated surfaces, respectively, each of which are connected to the corrugated surface of any one of the first upper rails which is positioned adjacent thereto.

According to a preferred embodiment of the present invention, the first upper rails are formed at the corrugated surfaces thereof with a plurality of protruded portions and grooves which are alternatively positioned, at least one of the protruded portions having a length different to lengths of the other protruded portions, the protruded portions formed at any one of the first upper rails being inserted into the grooves formed at the other first upper rails.

The first and second upper rails are assembled to the first and second lower rails by bolt means, respectively.

According to another preferred embodiment of the present invention, each of the first support members includes a first upper rail having a rectangular shape for frictionally making contact with the vehicle wheels and a first lower rail extending downward from the first upper rail so as to be assembled with each bracket, and the second support member includes a second upper rail having a rectangular shape for frictionally making contact with the vehicle wheels and a second lower rail extending downward from the second upper rail so as to be connected to the post.

The post is formed therein with a guide slot, along which the second ends of the first link members move, the second ends moving along the guide slot and simultaneously pivoting with respect to the post when an interval between first support members is changed, the second link member moving together with the first link members and pivoting with respect to the post so as to move the second support member.

According to a preferred embodiment of the present invention, between each of the first support members and second support members, a receiving pan is installed for drawing foreign stuffs out of the first and second link members. Latches are formed at opposing surfaces of the first and second support members for latching the receiving pans.

In a state of applying the expansion joint apparatus of the present invention to a bridge, each of the wheels in same shaft of a vehicle passes the joint apparatus on different members sometimes, that is, when any one wheel passes on one of the support members, the other wheel passes on the other support member. Thus, a load applied to the vehicle body and the bridge is distributed. Also, the expansion joint apparatus of the present invention is made of material having high stiffness so that it lasts a long time. In addition, by changing the number of the intermediate support member, the expansion range of the expansion joint apparatus can be controlled. Further more, the upper rails of the support members can be easily installed and replaced by new rails so that the maintenance and repair thereof are easy.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, an expansion joint apparatus of a preferred embodiment in accordance with the present invention will be explained in more detail with reference to the accompanying drawings.

Figure 1:
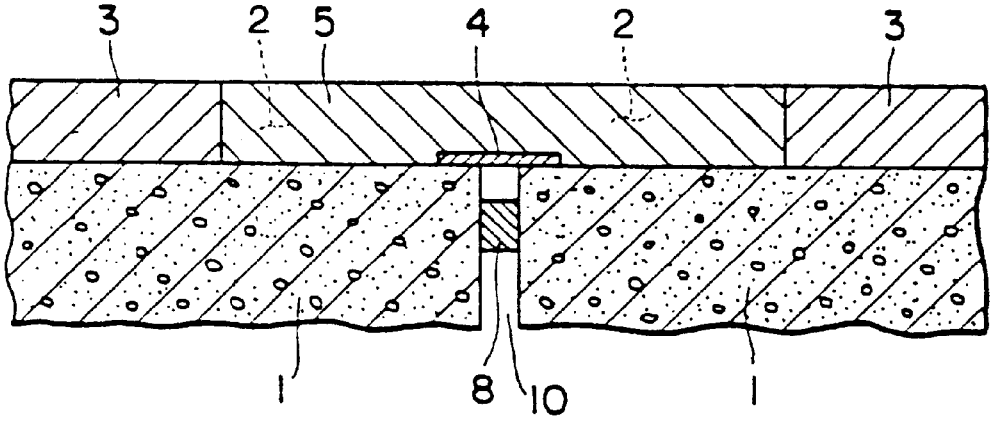
FIG. 1 (PRIOR ART)
FIG. 1 a sectional view showing a state where a conventional expansion joint has been applied.
Figure 2:
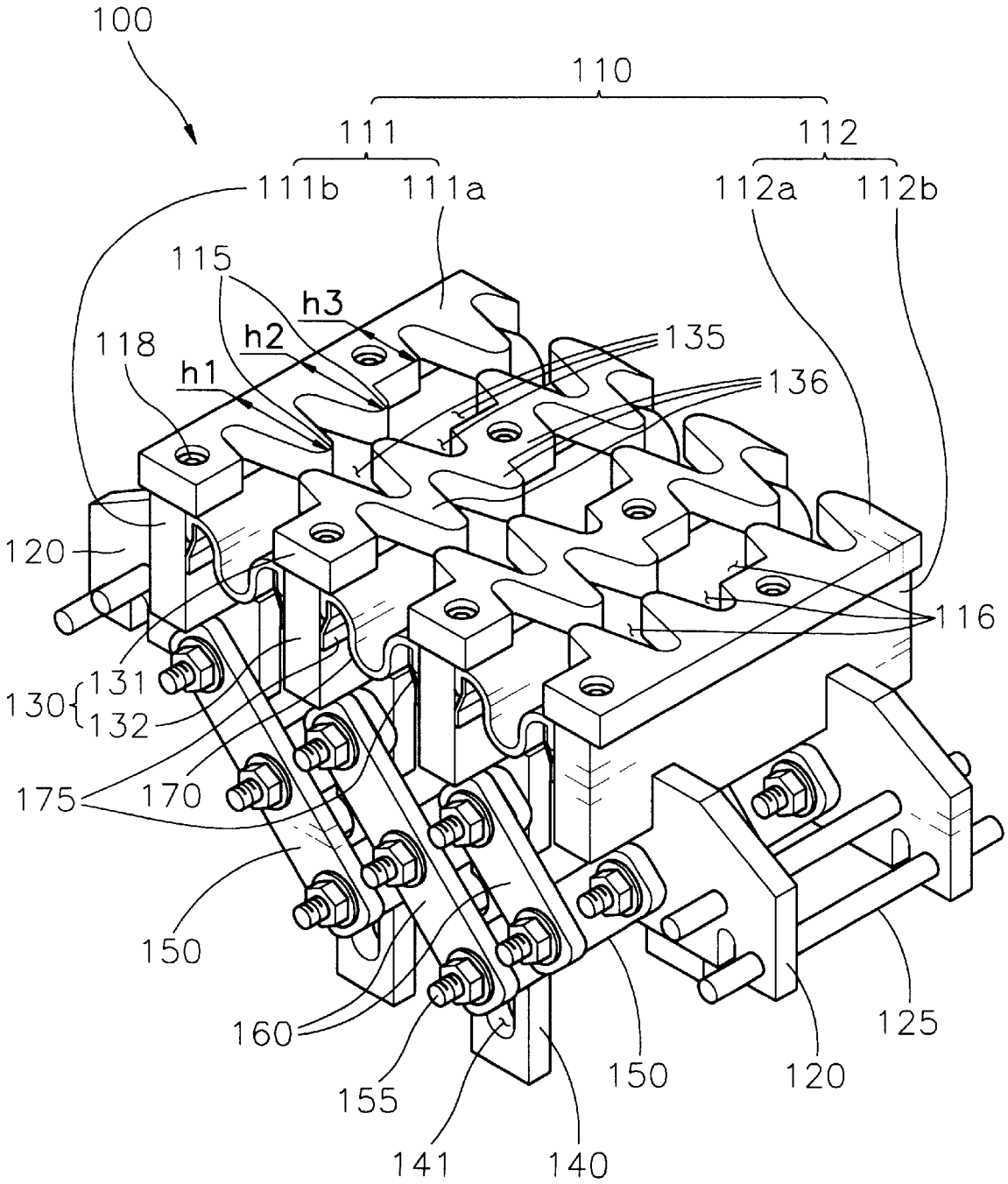
FIG. 2 is a perspective view of an expansion joint apparatus according to a preferred embodiment of the present invention.
Figure 3:
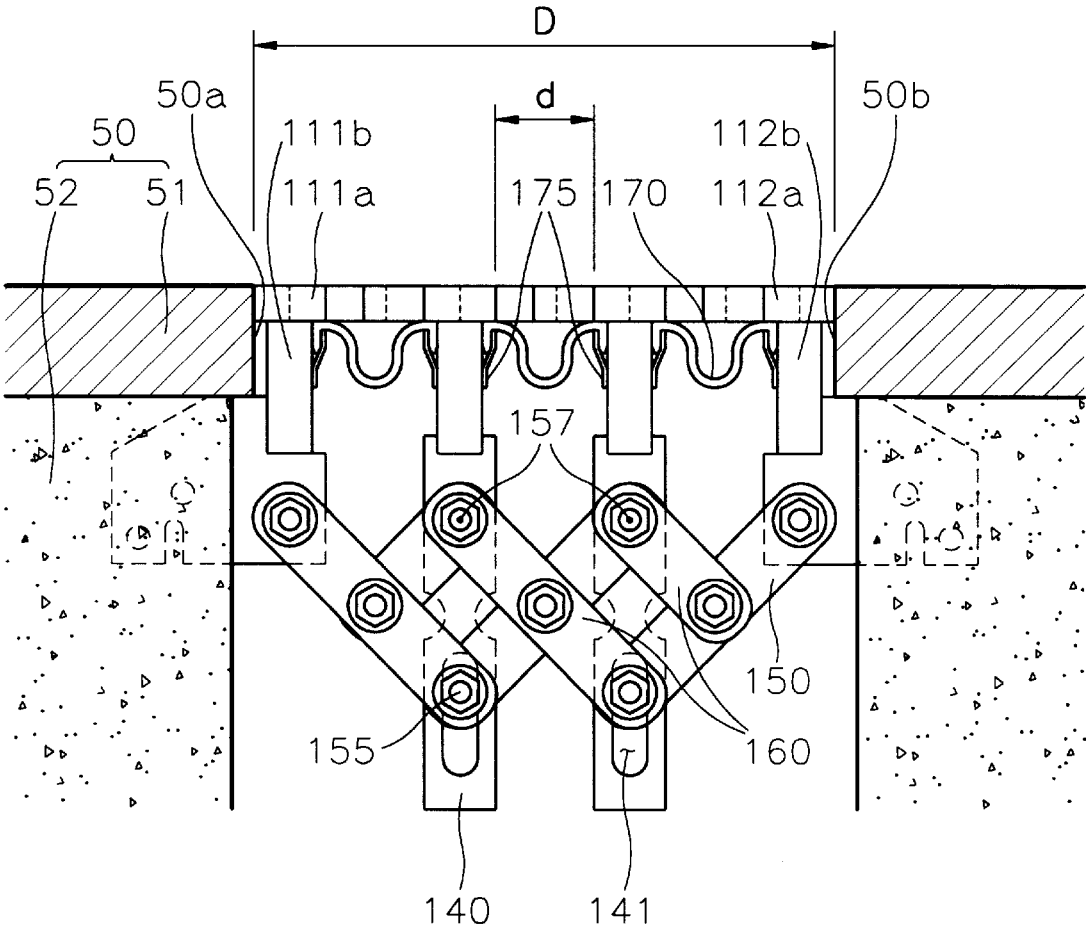
FIG. 3 is a front view of the expansion joint apparatus shown in FIG. 2.
Figure 4:
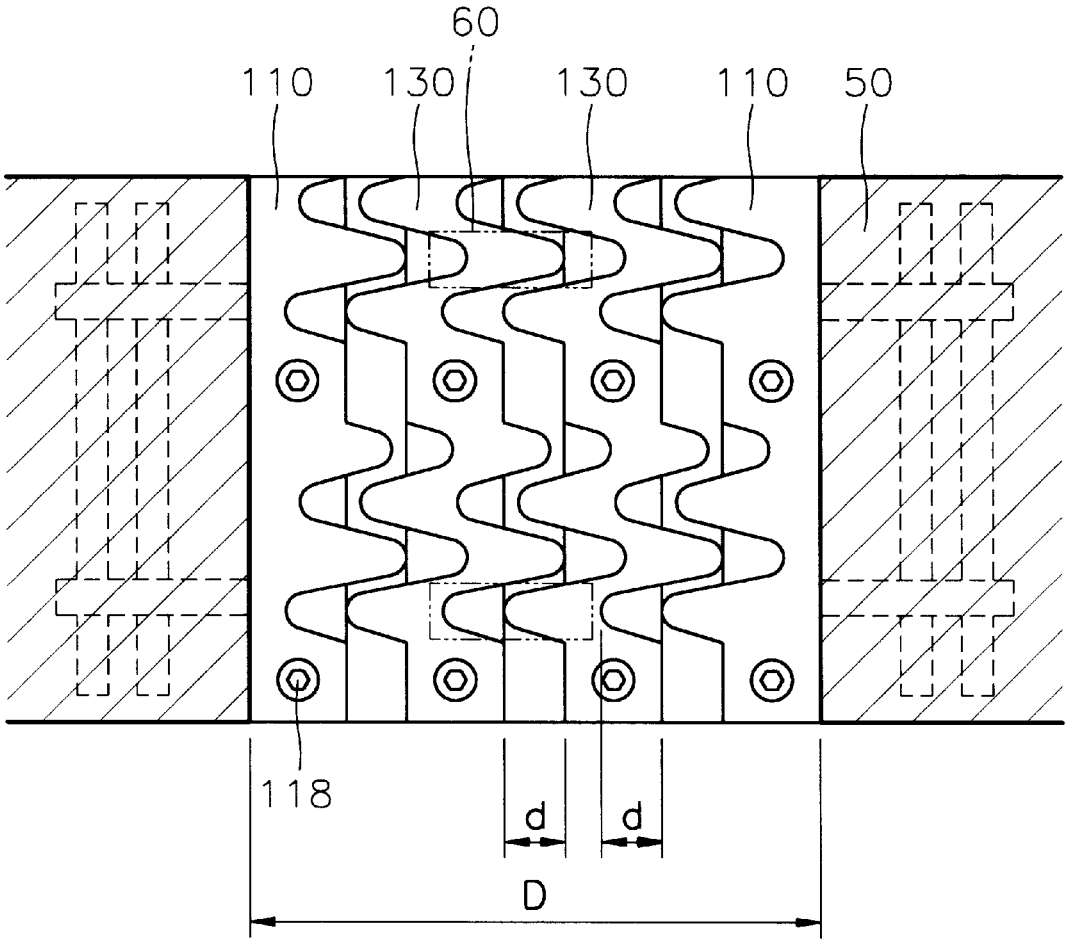
FIG. 4 is a plan view of the expansion joint apparatus shown in FIG. 2.
Figure 5:
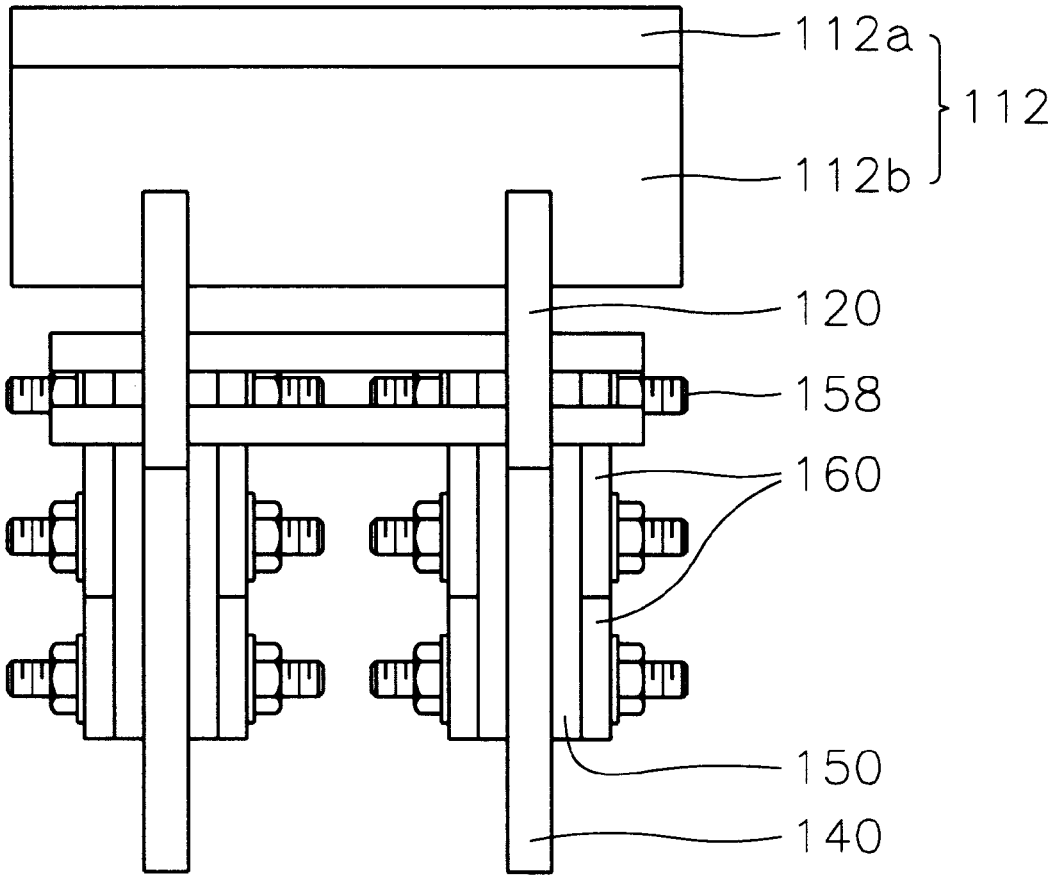
FIG. 5 is a side view of the expansion joint apparatus shown in FIG. 2.

FIG. 2 is a perspective view of an expansion joint apparatus 100 according to a preferred embodiment of the present invention and FIGS. 3 to 5 are front, plan, and side views of the expansion joint apparatus show in FIG. 2.

Referring to FIGS. 2 to 5, slabs 50 of a bridge are constructed with a predetermined interval D between each other and the expansion joint apparatus 100 of the embodiment is installed therebetween. Generally, each slab 50 is consisted of asphalt beam 51 and concrete beam 52.

Expansion joint apparatus 100 has first support member 110 having a couple of members 111 and 112 which are assembled to confronting surfaces 50*a* and 50*b*. First support member 110 prevents vehicle wheels from being sunk into the idle space between slabs 50 and also prevents vehicle bodies from being impacted by the height difference of adjacent slabs 50. Moreover, when slabs 50 contract or expand due to thermal heat, first support members 111 and 112 compensate the clearance D thereof by self-telescoping.

First support member 110 includes first upper rails 111*a* and 112*a* for making a frictional contact with the wheels and first lower rails 111*b* and 112*b* extending downward from first upper rails 111*a* and 112*a*. First upper and lower rails 111*a* and 111*b*, and also 112*a* and 112*b* are assembled with each other by bolt means so as to be easily separated later when required.

First upper rails 111*a* and 112*a* have corrugated surfaces which connect to each other. First upper rail 111*a* is formed at a side thereof facing the other first upper rail 112*a* with a plurality of protruded portions 115. Protruded portions 115 which are adjacent to each other have different lengths h1, h2, and h3, or one which has a different length from the others. The other first upper rail 112*a* is formed at a side thereof facing the corrugated surface of first upper rail 111*a* with a plurality of grooves 116 into which protruded portions 115 of first upper rail 111*a* are inserted. Since protruded portions 115 and corresponding grooves 116 are formed irregularly, each of the wheels 60 of a vehicle passes along the idle space d at a different time spot. (referring to FIG. 4) Thus, a load applied to the bridge is distributed while the vehicle passes thereon.

Referring again to FIG. 2, between slab 50 and first support member 110, a pair of brackets 120 are installed for transmitting a forward or a backward movement of slab 50 to first support member 100. One side of each bracket 120 is buried into slab 50 adjacent thereto and the other side thereof is secured to first lower rail 111*b* by welding. In the portion where each bracket is buried into slab, there are support rods 125 for connecting pairs of brackets 120.

Between first support members 111 and 112, at least one second support member 130 is assembled. Second support member 130 prevents the wheels from being sunk between first support members 111 and 112 and attenuates an impact applied to the vehicle which occurs due to the height difference of first support members 111 and 112.

Second support member 130 includes a second upper rail 131 for frictionally making contact with the vehicle wheels and a second lower rail 132 extending downward therefrom. Second upper rail 131 has a corrugated shape corresponding to the shape of first upper rail 111*a* at a side thereof facing first upper rail 111*a*, and has a corrugated shape corresponding to the shape of first upper rail 112*a* at a side thereof facing first upper rail 112*a*. That is, second upper rail 131 is formed with a plurality of grooves 135 into which protruded portions 115 of first upper rail 111*a* are inserted and also is formed with a plurality of protruded portions 136 inserted into grooves 116 of first upper rail 112*a*.

By changing the number of second support members 130, an expansion range of the expansion joint apparatus of the present invention can be controlled. Thus, the expansion joint apparatus can be properly installed at a bridge according to an expansion range of the bridge. Meanwhile, second upper rail 131 is assembled to second lower rail 132 by bolt means 118.

Therefore, first and second upper rails 111*a*, 112*a*, and 131 can be easily assembled/disassembled to/from first and second lower rails 111*b*, 112*b*, and 132, respectively. Thus, the installation, maintenance, and repair thereof are easy.

Meanwhile, a post 140 extends downward from second lower rail 132. First and second link members 150 and 160 for connecting first and second support member 110 and 130 are assembled to post 140.

First link member 150 is connected at one end thereof to bracket 120 and is connected at the other end thereof to post 140. Post 140 is formed with guide slot 141 through which an assembling means 155 for assembling first link member 150 and post 140 is assembled. Thus, when first support members 111 and 112 contract or expand, the assembled end portion of first link member 150 to post 140 moves downward or upward along guide slot 141. At the same time, first link member 150 pivots with respect to post 140.

Second link member 160 is connected at one end thereof to bracket 120 and is connected at the other end thereof to first link member 150. Thus, second link member 160 moves linearly by first link member 150 and pivots with respect to post 140 so that second support member 130 moves therewith.

Brackets 120 and post 140 are arranged in such a manner that a virtual line connecting them is linear. And first and second link members 110 and 130 are arranged at both sides of post 140 such that first and second support members move exactly together.

By post 140 and first and second link members 150 and 160, first and second support members 110 and 130 do not droop under the self-weight thereof and an external load.

Between first and second support members 111 and 130, and 112 and 130, receiving pans 170 are provided. Receiving pans 170 prevents material from coming in contact with first and second link members 150 and 160 so as to prevent expansion joint apparatus 100 and the bridge from being damaged.

Latches 175 are provided at the confronting surfaces of first and second support members 110 and 130 for securing receiving pan 170 thereto.

Preferably, first and second upper rails 111*a*, 112*a* and 131 of first and second support members 110 and 130 are made of materials such as steel which has a relatively high stiffness.

Hereinafter, an expansion joint apparatus according to another embodiment in accordance with the present invention will be described with FIGS. 6 to 8.

Figure 6:
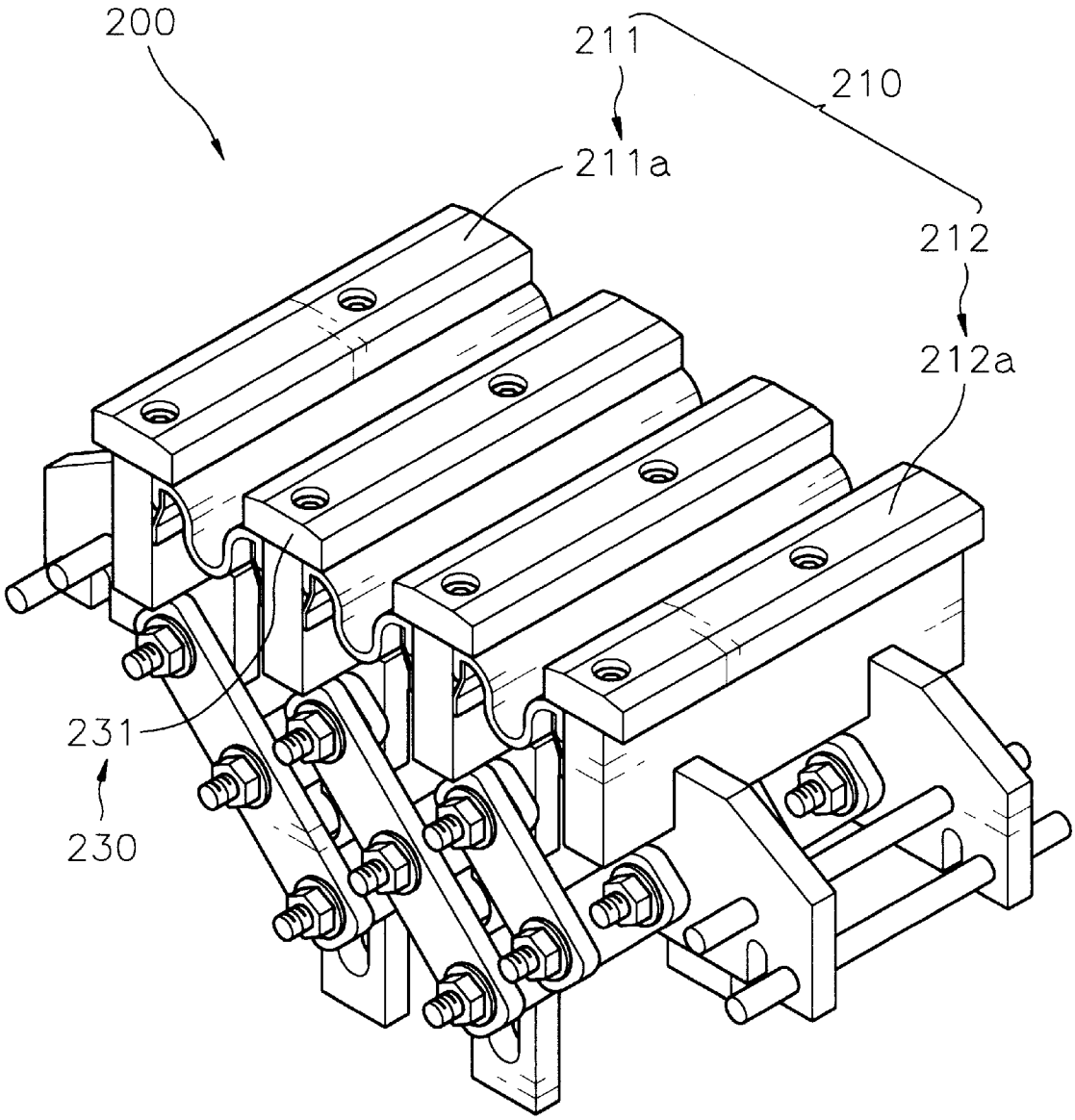
FIG. 6 is a perspective view of an expansion joint apparatus according to an another embodiment of the present invention.
Figure 7:
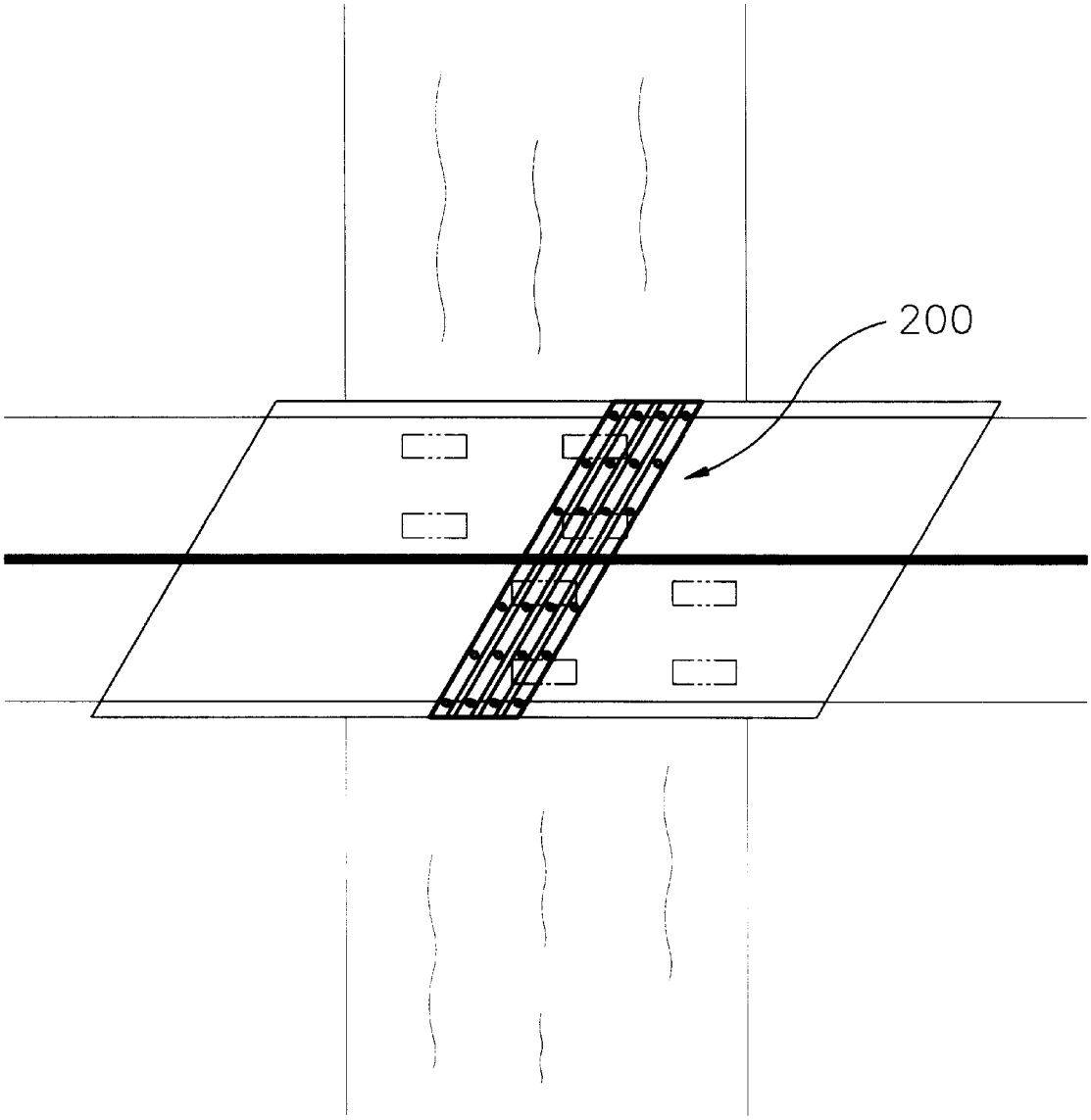
FIGS. 7 and 8 are plan views showing states where the expansion joint apparatus shown in FIG. 6 is installed to a bridge.
Figure 8:
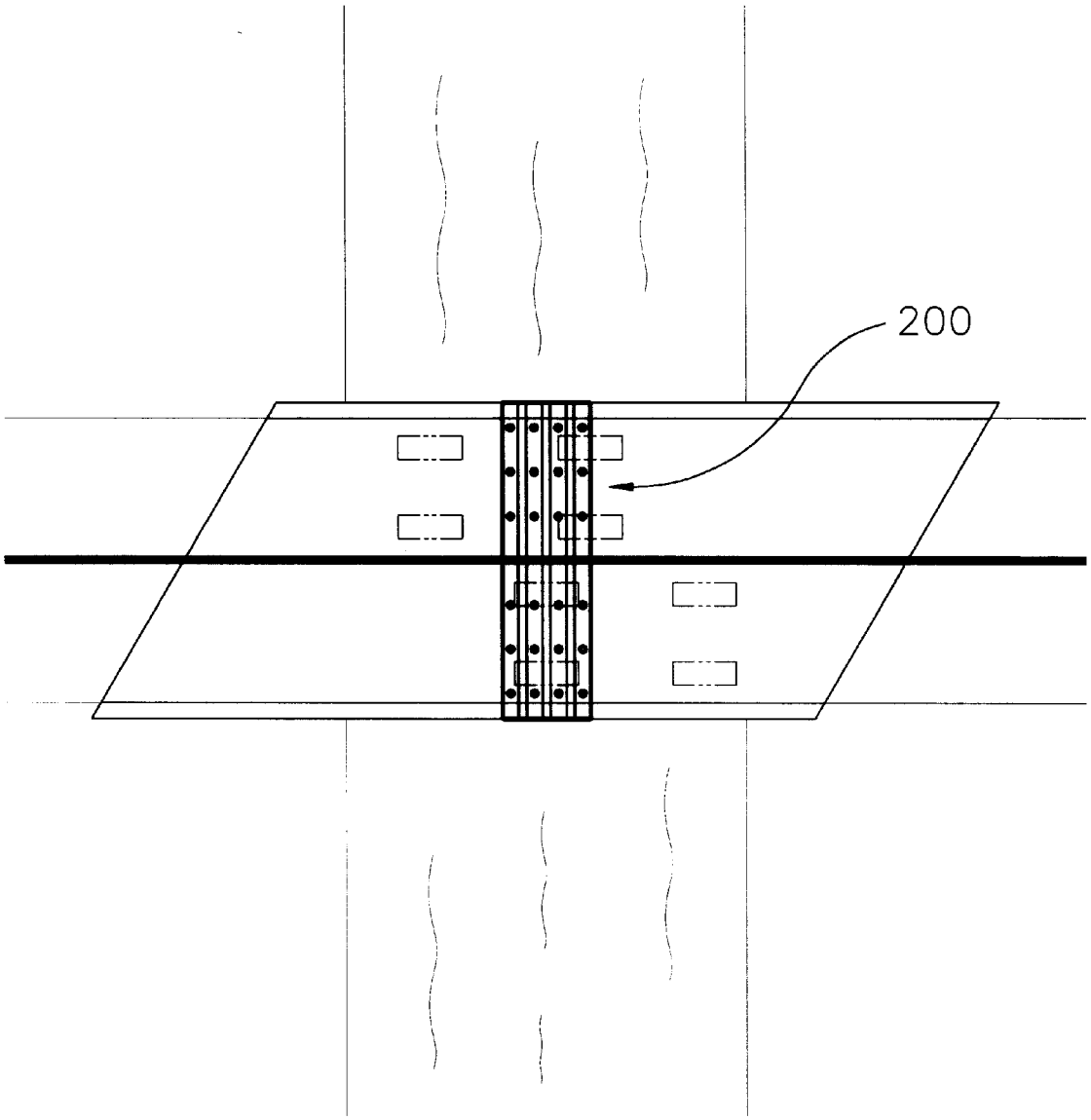

FIG. 6 is a perspective view of an expansion joint apparatus 200 of this embodiment, and FIGS. 7 and 8 are plan views showing states where apparatus 200 is installed to a bridge.

In expansion joint apparatus 200, first and second upper rails 211*a*, 212*a*, and 231 of first and second support members 210 and 230 have rectangular shapes. Another configuration of this expansion joint apparatus 200 is the same as that of expansion joint apparatus 100 of first embodiment. Expansion joint apparatus 200 is utilized at a bridge having a diamond-shaped configuration when viewed from above.

At this case, since each of the vehicle wheels passes first and second support members 210 and 230 at different time spots, an impact which occurs between the vehicle body and the bridge is attenuated.

As described above, in a state of applying the expansion joint apparatus of the present invention to a bridge, each of the wheels in a same shaft of a vehicle passes the joint apparatus on different members, that is, when any one wheel passes on one of the support members, the other wheel passes on the other support member. Thus, a load applied to the bridge is distributed. Also, the expansion joint apparatus of the present invention is made of material having high stiffness so that it lasts a long time. In addition, by changing the number of the intermediate support members, the expansion range of the expansion joint apparatus can be controlled. Further still, the upper rails of the support members can be easily installed and replaced by new rails so that the maintenance and repair thereof are easy.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. An expansion joint apparatus for connecting slabs which are spaced apart from each other by a predetermined interval, which comprises:

a couple of first support members for preventing vehicle wheels from being sunk between slabs and attenuating an impact occurred by a height difference of the slabs, the first support members being installed at confronting surfaces of the slab, respectively, each of the first support members including a first upper rail for frictionally making contact with the vehicle wheels and a first lower rail extending downward from the first upper rail so as to be assembled to each bracket, each of the first upper rails having a corrugated surface thereof confronting with the other first support member, the corrugated surfaces being engaged with each other and being formed with a plurality of protruded portions and grooves alternately arranged, at least one of the protruded portions having a length different to lengths of the other protruded portions to render the vehicle wheels juxtaposed to pass over different first upper rails respectively at a same time spot, thereby preventing a load concentration but distributing the load onto different first upper rails, the protruded portions formed at one of the first upper rails being inserted into the grooves formed at the other first upper rails;

a couple of brackets for transmitting movements of the slabs to the first support members, each bracket being installed between each first support member and the adjacent slab;

at least one second support member for preventing the vehicle wheels from being sunk between the first support members and attenuating an impact occurred by a height difference of the first support members, the second support member being installed between the first support members and moving together with the first support members, the second support member including a second upper rail for fictionally making contact with the vehicle and a second lower rail extending downward from the second upper rail, the second upper rail being formed at both sides thereof confronting with the first upper rails with corrugated surfaces, respectively, each of which being engaged with the corrugated surface of each of the first upper rails adjacent thereto;

a post extending downward from the second support member, the post being connected to the second low rail;

first link members for preventing the first and second support members from drooping under self-weights of the first and second support members and an external load, each first link member being connected at a first end thereof to each bracket and being connected at a second end thereof to the post, the second end being opposite to the first end; and second link members for preventing the first and seconds, support members from drooping under the self-weights of the first and second support members and the external load and urging the second support member to move together with the first support members, each second link member being connected at a third end thereof to the post and being connected at a fourth end thereof to each first link member adjacently positioned, the fourth end being opposite to the third end.

2. The apparatus as recited in claim 1, wherein the first and second upper rails are assembled to the first and second lower rails by bolt means, respectively.

3. The apparatus as recited in claim 1, wherein each of the first support members includes a first upper rail having a rectangular shape for frictionally making contact with the vehicle wheels and a first lower rail extending downward from the first upper rail so as to be assembled with each bracket, and the second support member includes a second upper rail having a rectangular shape for frictionally making contact with the vehicle wheels and a second lower rail extending downward from the second upper rail so as to be connected to the post.

4. The apparatus as recited in claim 1, wherein the post is formed therein with a guide slot, along which the second ends of the first link members move, the second ends moving along the guide slot and simultaneously pivoting with respect to the post when an interval between first support members is changed, the second link member moving together with the first link members and pivoting with respect to the post so as to move the second support member.

5. The apparatus as recited in claim 1, wherein between each of the first support members and second support members, a receiving pan is installed to prevent material from coming in contact with the first and second link members.

6. The apparatus as recited in claim 5, wherein latches are formed at opposing surfaces of the first and second support members for latching the receiving pans.

* * * * *